US006353178B1

(12) United States Patent
Linhart

(10) Patent No.: US 6,353,178 B1
(45) Date of Patent: Mar. 5, 2002

(54) VACUUM CLEANER TUBE WITH ELECTRICAL CONDUCTORS

(75) Inventor: Georg Peter Linhart, Wöllstadt (DE)

(73) Assignee: Truplast Kunst Stofftechnik GmbH, Langgöns (DE)

( * ) Notice: Subject to any disclaimer, the term of this patent is extended or adjusted under 35 U.S.C. 154(b) by 0 days.

(21) Appl. No.: 09/625,732

(22) Filed: Jul. 26, 2000

(30) Foreign Application Priority Data

Jul. 26, 1999 (DE) ..... 299 12 640

(51) Int. Cl.[7] ..... H01B 7/00

(52) U.S. Cl. ..... 174/47; 174/74 R; 138/138; 439/194

(58) Field of Search ..... 174/47, 74 R; 439/191, 194, 449, 451, 24, 195, 192, 193; 141/382, 279; 15/312.2; 138/122, 133, 126, 155, 138; 285/7, 903

(56) References Cited

U.S. PATENT DOCUMENTS 3,167,330 A * 1/1965 Draudt ..... 285/7
4,018,493 A * 4/1977 Lyman et al. ..... 339/15
4,099,744 A * 7/1978 Kutnyak et al. ..... 285/7
4,174,858 A * 11/1979 Brooks ..... 285/7
4,345,805 A * 8/1982 Finley et al. ..... 339/16 R
5,787,546 A * 8/1998 Ban et al. ..... 15/344
5,932,842 A * 8/1999 Eberl et al. ..... 174/47

* cited by examiner

*Primary Examiner*—Dean A. Reichard
*Assistant Examiner*—Dhiru R. Patel
(74) *Attorney, Agent, or Firm*—Horst M. Kasper

(57) ABSTRACT

A vacuum cleaner tube has electrical conductors and a tube having an inner wall and formed spirally on the outside and formed smoothly on the inside and having an end, a helical step disposed at the tube, an end bush having a rear end and plugged into the end of the tube, wherein the end bush exhibits an axial slot having flanks and open at the rear end of the end bush, and locking noses disposed at the end bush. A protective covering is attached at the inner wall of the tube. A projection is formed at the end bush and closed at its front end and formed for receiving the protective covering, wherein the flanks of the axial slot form a transition into the projection. A slip ring support has a longitudinal passing through slot for engaging the tube, wherein the slip ring support is made as a single part. Breakouts are furnished at the slip ring support for an engagement of the locking noses formed at the end bush. A plurality of electrical conductors are disposed in the protective covering.

6 Claims, 2 Drawing Sheets

VACUUM CLEANER TUBE WITH ELECTRICAL CONDUCTORS

BACKGROUND OF THE INVENTION

1. Field of the Invention

The invention relates to a vacuum cleaner tube with electrical conductors.

2. Brief Description of the Background of the Invention Including Prior Art

A vacuum cleaner tube with electrical conductors has already been proposed. The slip ring support is here connected to the tube by a thermoplastic material placed by an injection molding process. The end bush is attached in the tube in the same manner. The material employed for the attachment of the slip ring support on the tube and for the attachment of the end bush in the tube is either equal or similar to the material employed for the tube such that the connections produced with the tube material perform their purpose. The connections cannot be released in a destruction free way. The injection molding process is expensive, requires skilled personnel and particular equipment for performing the injection molding process.

A vacuum cleaner tube with electrical conductors is already known, wherein an end bush is plugged into one end of the two formed spirally on the outside and smooth on the inside. The slip ring support comprises a bush ring supporting a single slip ring and a sleeve furnished with two slip rings. The sleeve is on the one hand connected shape matching to the bush ring and on the other hand shape matching to the end bush. A thread step is disposed at the inner jacket face of the sleeve as described in the European printed patent document EP 0884019 A1.

SUMMARY OF THE INVENTION

1. Purposes of the Invention

It is an object of the present invention to provide a vacuum cleaner tube having electrical conductors, wherein the slip ring support is furnished without a thread step.

These and other objects and advantages of the present invention will become evident from the description which follows.

2. Brief Description of the Invention

The present invention provides a vacuum cleaner tube having electrical conductors and comprising a tube having an inner wall and formed spirally on the outside and formed smoothly on the inside and having an end, a helical step disposed at the tube, an end bush having a rear end and plugged into the end of the tube, wherein the end bush exhibits an axial slot having flanks and open at the rear end of the end bush, and locking noses disposed at the end bush. A protective covering is attached at the inner wall of the tube. A projection is formed at the end bush and closed at its front end and formed for receiving the protective covering, wherein the flanks of the axial slot form a transition into the projection. A slip ring support has a longitudinal passing through slot for engaging the tube, wherein the slip ring support is made as a single part. First breakouts are furnished at the slip ring support for an engagement of the locking noses formed at the end bush. A plurality of electrical conductors are disposed in the protective covering.

Slip rings are disposed on the slip ring support and connected in each case to a respective one of the plurality of electrical conductors, wherein the respective one of the plurality of electrical conductor is led to the coordinated slip ring through the axial slot of the end bush, and wherein the end bush and the slip ring support are axially form matchingly and disengageably fixed in a final position. An intermediate sleeve has a front end and exhibits a pass through slot congruent in its final position with the axial slot of the end bush and the passing through slot of the slip ring support. Two second breakouts are furnished at a front end of the intermediate sleeve, wherein in each case one of the locking noses formed at the end bush engages in the final position of the two second breakouts. A raised thread step is disposed at the inner side of the intermediate sleeve and serving for axially form matchingly and disengageably fixing the end bush and the slip ring support in a final position, wherein the raised thread step is screwed to the helical step of the tube.

A circulating collar is disposed at a rear end of the intermediate sleeve and formed as an axial stop for the slip ring support. An axial nose is formed at the circulating collar of the intermediate sleeve for an engagement into the longitudinal passing through slot of the slip ring support.

The invention construction is associated with the advantage that the individual parts can be connected to each other in a more favorable and stable fashion as conventionally possible.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
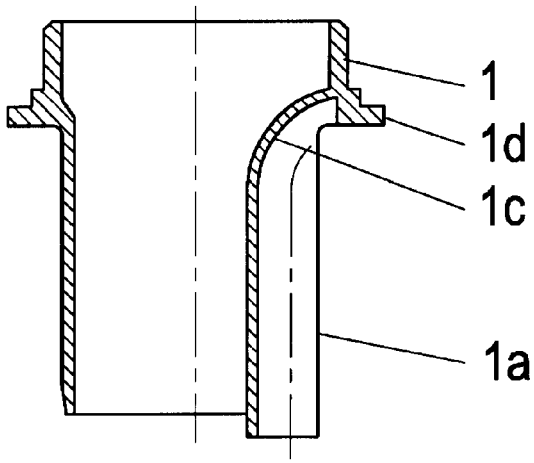
FIG. 1 shows a diagrammatic side elevational and in part sectional view of an end bush.
Figure 2:
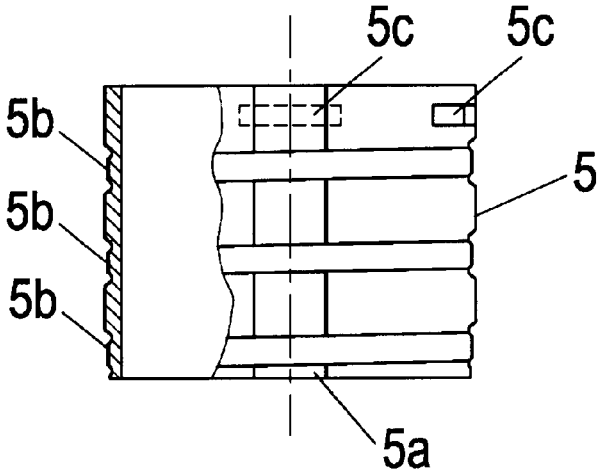
FIG. 2 shows a diagrammatic side elevational and in part sectional view of a slip ring support furnished with slip rings.
Figure 3:
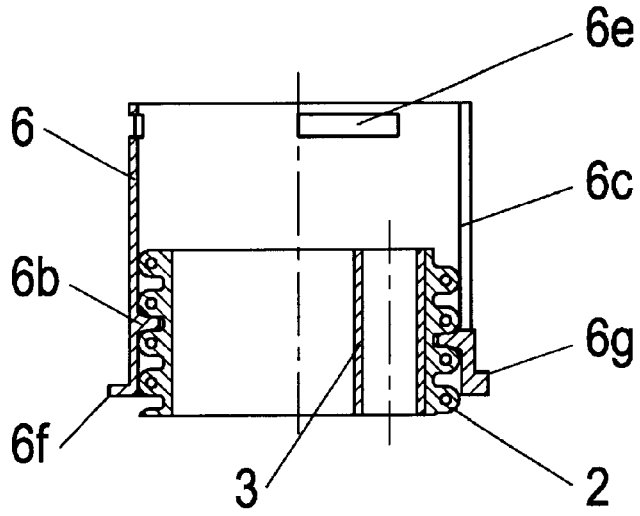
FIG. 3 shows a diagrammatic sectional view of a further part.
Figure 4:
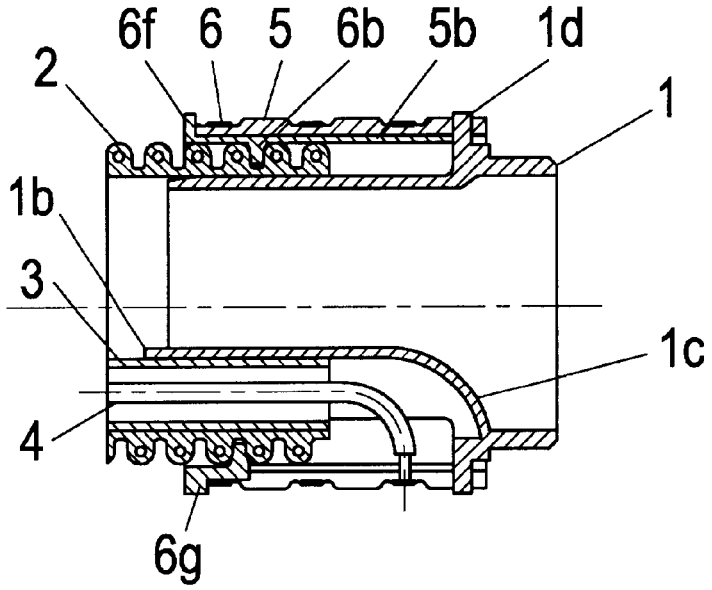
FIG. 4 shows a sectional view of the parts illustrated in FIGS. 1 through 3 in their final position.

In accordance with the present invention, an end bush is designated in the drawing with the reference numeral 1. The end bush 1 exhibits an open axial slot 1*a* at the rear end of the end bush 1. The flanks of the axial slot 1*a* turn into an about tubular projection 1*b*, wherein the tubular projection 1*b* is closed at its front end 1*c*. The diameter of the tubular projection can be from about 0.2 to 0.5 times the diameter of the end bush 1. The tubular projection 1*b* serves for receiving a protective covering or a protective sheathing 3 as shown in FIG. 4, wherein the protective covering or the protective sheathing 3 contains an electrical conductor 4. The protective covering or protective sheathing 3 is attached to the inside of a tube 2 formed spirally on the outside and having a smooth inner surface as shown in FIGS. 3 and 4.

A bush shaped slip ring support 5 grips around the tube 2, wherein the bush shaped slip ring support 5 exhibits a slot 5*a* gripping and extending through the whole length of the slip ring support 5. The slip ring support 5 is furnished with the three slip rings 5*b*, wherein the slip rings 5*b* are disposed in anullar grooves of the slip ring support 5 not designated with reference numerals and wherein the slip rings 5*b* are in each case connected to electrical conductor 4. Only a single electrical conductor 4 and a connection of the electrical conductor 4 to a slip ring 5*b* was drawn in FIG. 4 for an improved overview and for purposes of clarity.

The end bush 1 and the slip ring support 5 are fixed axially form matching in their final position. At least one raised thread step serves for this purpose, wherein the raised thread step is screwed to a helical step of the tube 2. The thread step is not formed at the inner side of the slip ring support 5 as is the case in the state-of-the-art recited, but instead formed at the inner side of an intermediate sleeve 6 according to the present invention and the thread step is designated in the illustrated example with reference numeral 6*b*. The intermediate sleeve 6 is disposed between the tube 2 and the slip ring support 5 and is furnished with a slot 6*c*, wherein the slot 6*c* is aligned in its final position to the slot 5*a* of the slip ring support 5 and to the tube slot 1*a* of the end bush 1, such that the conductor 4 can be led from the protective sheathing 3 through the slots 1*a*, 5*a*, and 6*c* to the coordinated slip ring support 5 as shown in FIG. 4.

At least two second breakouts 6*e* are disposed at the front end of the intermediate sleeve 6, wherein in each case a locking nose 1*d* furnished at the end bush 1 engages into the final position of the two second breakouts 6*e*. A mutual axial arresting of the end bush 1 and of the intermediate sleeve 6 is assured by the second engagement of the locking nose 1*d* of the end bush 1 into the breakouts 6*e* of the intermediate sleeve 6 as shown in FIG. 4.

A circulating shoulder 6*f* is formed at the rear end of the intermediate sleeve 6, wherein the circulating shoulder 6*f* serves as a rest collar for the rear end of the slip ring support 5.

An axial nose 6*g* for an engagement into the slot 5*a* of the slip ring support or collector ring support 5 is formed at the circulating shoulder 6*f* of the intermediate sleeve 6, whereby the slip ring support 5 is radially arrested.

First breakouts for the engagement of the locking noses 1*d* formed at the end bush 1 and designated with the reference numeral 5*c* are furnished also in the slip ring support 5, whereby simultaneously a mutual radial and axial arresting is achieved between the end bush 1 and the slip ring support 5.

The electrical conductors are disposed in a protective covering attached at the inner wall of the tube.

An end bush 1 is plugged one end of the tube 2 formed spirally on the outside and formed smoothly on the inside, wherein the end bush 1 exhibits an axial slot 1*a* open at the rear end of the end bush 1, wherein the flanks of the axial slot 1*a* form a transition into a projection 1*b* closed at its front end 1*c* and formed for receiving the protective covering 3.

A throughout longitudinally slotted slip ring support 5 engages the tube 2, wherein the slip rings 5*b* of the slip ring support 5 are connected in each case to one of the electrical conductors 4, wherein the electrical conductor 4 is led to the coordinated slip ring 5*b* through the axial slot 1*a* of the end bush 1.

The end bush 1 and the slip ring support 5 are axially form matchingly and disengageably fixed in their final position, wherein at least one raised thread step 6*b* serves for that purpose, and wherein the thread step 6*b* is screwed to a helical step of the tube 2. The slip ring support 5 is made as a single part.

The thread step 6*b* is disposed at the inner side of an intermediate sleeve 6, wherein the intermediate sleeve 6 exhibits a pass through slot 6*c* congruent in its final position with the axial slot 1*a* of the end bush 1 and the passing through slot 5*a* of the slip ring support (5).

At least two second breakouts 6*e* are furnished at a front end of the intermediate sleeve 6, wherein in each case a locking nose id formed at the end bush 1 engages in the final position of the two second breakouts 6*e*. The slip ring support 5 is furnished with first breakouts 5*c* for the engagement of the locking noses 1*d* formed at the end bush 1.

The intermediate sleeve 6 exhibits a circulating collar 6*f* at the rear end of the intermediate sleeve 6 and formed as an axial stop for the slip ring support 5. An axial nose 6*g* is formed at the circulating collar 6*f* of the intermediate sleeve 6 for the engagement into the slot 5*a* of the slip ring support 5.

All parts of the described structure comprise a thermoplastic material.

It will be understood that each of the elements described above, or two or more together, may also find a useful application in other types of hose connection system configurations and electrical power transferring procedures differing from the types described above.

While the invention has been illustrated and described as embodied in the context of a vacuum cleaner tube with electrical conductors, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A vacuum cleaner tube having electrical conductors comprising a tube having an inner wall and formed spirally on the outside and formed smoothly on the inside and having an end;

a helical step disposed at the tube;

an end bush having a rear end and plugged into the end of the tube, wherein the end bush exhibits an axial slot having flanks and open at the rear end of the end bush;

locking noses disposed at the end bush;

a protective covering attached at the inner wall of the tube;

a projection formed at the end bush and closed at its front end and formed for receiving the protective covering, wherein the flanks of the axial slot form a transition into the projection;

a slip ring support having a longitudinal passing through slot for engaging the tube, wherein the slip ring support is made as a single part;

first breakouts furnished at the slip ring support for an engagement of the locking noses formed at the end bush;

a plurality of electrical conductors disposed in the protective covering;

slip rings disposed on the slip ring support and connected in each case to a respective one of the plurality of electrical conductors, wherein the respective one of the plurality of electrical conductor is led to the coordinated slip ring through the axial slot of the end bush, wherein the end bush and the slip ring support are axially form matchingly and disengageably fixed in a final position;

an intermediate sleeve having a front end and exhibiting a pass through slot congruent in its final position with the axial slot of the end bush and the passing through slot of the slip ring support;

at least two second breakouts furnished at a front end of the intermediate sleeve, wherein in each case one of the locking noses formed at the end bush engages in the final position of the at least two second breakouts;

a raised thread step disposed at the inner side of the intermediate sleeve and serving for axially form matchingly and disengageably fixing the end bush and the slip ring support in a final position, wherein the raised thread step is screwed to the helical step of the tube.

2. The vacuum cleaner tube according to claim 1 further comprising a circulating collar disposed at a rear end of the intermediate sleeve and formed as an axial stop for the slip ring support.

3. The vacuum cleaner tube according to claim 2 further comprising an axial nose formed at the circulating collar of the intermediate sleeve for an engagement into the longitudinal passing through slot of the slip ring support.

4. A vacuum cleaner tube with electrical conductors, wherein the electrical conductors are disposed in a protective covering attached at the inner wall of the tube, comprising an end bush (1) is plugged into one end of the tube (2) formed spirally on the outside and formed smoothly on the inside, wherein the end bush (1) exhibits an axial slot (1*a*) open at the rear end of the end bush (1), wherein the flanks of the axial slot (1*a*) form a transition into a projection (1*b*) closed at its front end (1*c*) and formed for receiving the protective covering (3);

a throughout longitudinally slotted slip ring support (5) engages the tube (2), wherein a slip ring (5*b*) of the slip ring support (5) is connected in each case to one of the electrical conductors (4), wherein the electrical conductor (4) is led to the slip ring (5*b*) through the axial slot (1*a*) of the end bush (1);

wherein the end bush (1) and the slip ring support (5) are axially form matchingly and disengageably fixed in their final position, wherein at least one raised thread step (6*b*) serves for that purpose, wherein the thread step (6*b*) is screwed to a helical step of the tube (2);

wherein the slip ring support (5) is made as a single part;

wherein the thread step (6*b*) is disposed at the inner side of an intermediate sleeve (6), wherein the intermediate sleeve (6) exhibits a pass through slot (6*c*) congruent in its final position with the axial slot (1*a*) of the end bush (1) and the passing through slot (5*a*) of the slip ring support (5);

at least two second breakouts (6*e*) are furnished at a front end of the intermediate sleeve (6), wherein in each case a locking nose (1*d*) formed at the end bush (1) engages in the final position of the two second breakouts (6*e*);

wherein the slip ring support (5) is furnished with first breakouts (5*c*) for the engagement of the locking noses (1*d*) formed at the end bush (1).

5. The vacuum cleaner tube according to claim 4, wherein the intermediate sleeve (6) exhibits a circulating collar (6*f*) at the rear end of the intermediate sleeve (6) and formed as an axial stop for the slip ring support (5).

6. The vacuum cleaner tube according to claim 5, wherein an axial nose (6*g*) is formed at the circulating collar (6*f*) of the intermediate sleeve (6) for the engagement into the slot (5*a*) of the slip ring support (5).

* * * * *